US011555315B2

(12) United States Patent
Beaumont

(10) Patent No.: US 11,555,315 B2
(45) Date of Patent: Jan. 17, 2023

(54) TOOL FOR THE IN SITU CONSTRUCTION OF A SANDWICH WALL, AND METHOD APPLYING SAME

(71) Applicant: G.B.E., Roanne (FR)

(72) Inventor: Gilles C. Beaumont, Le Coteau (FR)

(73) Assignee: G.B.E., Roanne (FR)

( * ) Notice: Subject to any disclaimer, the term of this patent is extended or adjusted under 35 U.S.C. 154(b) by 339 days.

(21) Appl. No.: 16/755,621

(22) PCT Filed: Oct. 16, 2018

(86) PCT No.: PCT/FR2018/052567
§ 371 (c)(1),
(2) Date: Apr. 13, 2020

(87) PCT Pub. No.: WO2019/077257
PCT Pub. Date: Apr. 25, 2019

(65) Prior Publication Data

US 2021/0372147 A1 Dec. 2, 2021

(30) Foreign Application Priority Data

Oct. 19, 2017 (FR) ..... 17 59819

(51) Int. Cl.
*E04G 11/18* (2006.01)
*E04C 5/16* (2006.01)
(Continued)

(52) U.S. Cl.
CPC ..... *E04G 11/18* (2013.01); *E04C 2/288* (2013.01); *E04C 5/168* (2013.01); *E04C 5/206* (2013.01);
(Continued)

(58) Field of Classification Search
CPC ..... E04C 2/288; E04C 5/168; E04C 5/206; E04C 2002/047; E04G 17/0758;
(Continued)

(56) References Cited

U.S. PATENT DOCUMENTS 2,645,929 A * 7/1953 Jones ..... E04C 5/168 52/713
4,234,156 A * 11/1980 Wepf ..... E04C 5/168 249/40
(Continued)

FOREIGN PATENT DOCUMENTS

BE 826 054 6/1975
CA 2272729 A1 * 2/2000 ..... E04G 11/18
(Continued)

*Primary Examiner* — Michael Safavi
(74) *Attorney, Agent, or Firm* — Clark & Brody LP

(57) ABSTRACT

A tooling for manufacturing a wall with two concrete walls, between which at least one insulation panel is trapped includes at least one system for positioning the insulation panel composed, on one hand of a dagger having a rod provided with a bearing stop and, on the other hand, of a lock provided with a counter-stop. The lock has at least two notches for receiving a first reinforcement, arranged locally on the circumference of the positioning system, extending set back from a first end of the rod, delimited on either side by retaining stops spaced apart so as to maintain in position the first reinforcement, and defines a housing with a profile converging in the opposite direction to their opening, and arranged according to the length of the positioning system to be able to adjust the position of the first reinforcement according to the length of the positioning system.

17 Claims, 11 Drawing Sheets

(51) Int. Cl.
*E04C 5/20* (2006.01)
*E04C 2/288* (2006.01)
*E04G 17/065* (2006.01)
*E04C 2/04* (2006.01)

(52) U.S. Cl.
CPC .... *E04G 17/0654* (2013.01); *E04C 2002/047* (2013.01)

(58) Field of Classification Search
CPC . E04G 11/18; E04G 17/0658; E04G 17/0728; E04B 1/7616
USPC ..... 52/309.11, 309.14, 309.16; 249/38
See application file for complete search history.

(56) References Cited

U.S. PATENT DOCUMENTS 4,329,821 A * 5/1982 Long ..... E04G 11/18 52/410
4,805,366 A * 2/1989 Long ..... E04C 2/288 249/40
5,673,525 A * 10/1997 Keith ..... F16B 19/14 411/487
5,996,297 A * 12/1999 Keith ..... E04C 5/20 52/685
6,832,456 B1 * 12/2004 Bilowol ..... E04G 17/0651 249/40
2004/0035073 A1 * 2/2004 Bravinski ..... E04C 5/203 52/426
2004/0237438 A1 * 12/2004 Keith ..... E04G 11/18 52/428
2005/0016095 A1 * 1/2005 Long, Sr. ..... E04C 2/044 403/283
2005/0108985 A1 5/2005 Bravinski
2009/0256055 A1 * 10/2009 Foser ..... E04G 17/064 249/190
2012/0180411 A1 * 7/2012 Trimmer ..... E04C 2/044 52/794.1
2014/0087158 A1 * 3/2014 Ciuperca ..... B32B 3/266 428/223
2014/0260055 A1 * 9/2014 Pfeiffer ..... E04G 17/12 52/582.1
2017/0058520 A1 * 3/2017 Keith ..... E04C 2/044

FOREIGN PATENT DOCUMENTS

CH 469150 A * 2/1969 ..... E04B 2/86
DE 2405209 A1 * 8/1974 ..... E04C 5/168
DE 2337714 A1 * 2/1975 ..... E04C 5/168
DE 2715277 A1 * 10/1978 ..... E04B 1/04
DE 3037010 A1 * 5/1982 ..... E04C 5/168
DE 4337523 A1 * 5/1994 ..... E04C 5/168
DE 202020103919 U1 * 9/2020 ..... E04C 2/46
EP 0029486 A1 * 6/1898 ..... E04G 11/18
EP 0 073 553 3/1983
EP 2792804 B1 * 7/2016 ..... E04B 1/4121
FR 2303912 A1 * 10/1976 ..... E04C 5/168
FR 2633322 A1 * 12/1989 ..... E04C 5/168
FR 2956871 A1 * 9/2011 ..... E04C 5/16
WO WO-9918302 A1 * 4/1999 ..... E04C 2/288
WO WO-2007053027 A1 * 5/2007 ..... E04G 11/18
WO 2011/107696 9/2011
WO WO-2018176088 A1 * 10/2018 ..... E04C 5/168
WO WO-2019198078 A1 * 10/2019 ..... E04B 2/8652
WO WO-2021014160 A1 * 1/2021 ..... E04B 5/48

* cited by examiner

TOOL FOR THE IN SITU CONSTRUCTION OF A SANDWICH WALL, AND METHOD APPLYING SAME

The present invention relates to the field of the construction of walls of buildings or structures in the general sense and aims more specifically the manufacture in situ and simultaneously of two concrete walls separated by a thermal insulation panel.

In the state of the art, the various advantages linked to the manufacture of sandwich walls, including two concrete walls separated by an insulation panel, are known, in particular in terms of thermal insulation. The state of the art has proposed various technical solutions for the manufacture in situ of such sandwich walls integrating a thermal insulation.

For example, European patent application 0 073 553 describes a device and a method for manufacturing a wall including two parallel vertical concrete walls between which an insulation panel is trapped. The two concrete walls are manufactured simultaneously or substantially simultaneously by pouring concrete between the insulation panel and two parallel form panels. The insulation panel is centered between the front form panels before pouring the concrete, using positioning systems passing through the insulation panel and bearing on the inner faces of the two form panels. The form panels are maintained in position using assembly devices disposed outside the wall to be manufactured. The assembly devices are thus removed after solidification of the concrete while the positioning systems remain trapped in the wall thus manufactured.

The implementation of this technique has a major drawback linked to the phenomenon of lifting of the insulation panel which appears during the concrete pouring operation in situ. Another drawback relates to the difficulty of implementing such a method upon integration of structural reinforcement into the concrete walls in the case where the built wall must have good mechanical resistance or mechanical strength characteristics. The device described does not allow maintaining in position the reinforcement during the step of pouring the concrete, nor the prior adjustment of its positioning.

In the same sense, document US 2005/0108985 describes a device and a method for manufacturing a wall including two parallel vertical concrete walls between which an insulation panel is inserted. The insulation panel is held between two form panels, before pouring the concrete, using systems for positioning the insulation panel and assembling the form panels. Each positioning and assembly system includes a rod passing through the insulation panel so that each threaded end of the rod is intended to receive a threaded bush ensuring the assembly of the form panels. Each form panel bears through its inner face, on a ring inserted on a bush and bearing on the insulation panel or on the reinforcement interposed between the insulation panel and a form panel.

Such a method presents a major difficulty in placing the various members of the positioning and assembly systems. Furthermore, the device imposes a mounting in abutment between the insulation panel and the reinforcement, and then does not allow maintaining the reinforcement effectively. In addition, this device does not allow adjustment of the position of the reinforcement. Finally, it turns out that such a method does not allow obtaining a wall with good mechanical resistance and retention characteristics from one wall to another.

In order to overcome the drawbacks of the state of the art, the Applicant has previously described in the application WO 2011/107696 a tooling and a method for manufacturing in situ a vertical sandwich wall with two concrete walls separated by an insulation panel allowing the integration of a reinforcement in the concrete walls. This tooling includes systems for positioning the insulation panel between the form panels, as well as devices for assembling the form panels together. The positioning systems each include, on the one hand, a dagger having a rod provided with a bearing stop and, on the other hand, a lock provided with a counter-stop and an angularly adapted orientable hook to cooperate with a reinforcement. The assembly devices each include a tubular spacer inside which a tightening rod provided at each end of a tightening member passes.

This tooling has the advantage of maintaining in position the insulation panel during the concrete pouring operation. On the other hand, under some conditions of implementation, maintaining the reinforcement during the pouring of the concrete does not seem sufficient. Complementarily, this tooling does not offer the possibility of being able to adjust the position of the reinforcement relative to the insulation panel. In addition, this tooling allows maintaining only one reinforcement.

There is also known from document U.S. Pat. No. 5,996,297 a tooling and a method for manufacturing a wall with two concrete walls comprising a reinforcing material between which an insulation panel is trapped. This tooling composed of a rod provided at one end with hooks and at the other end with notches, in order to maintain a reinforcing material.

This tooling has the disadvantage of being able to cooperate only with a reinforcing material having a size corresponding to that of the hooks, and of not being able to adapt to materials having various sizes. In addition, the position of the reinforcement material is determined by the position of the hooks and cannot be adjusted during the manufacture of the wall. In other words, the reinforcing material must adapt to the tooling as described in this document.

The present invention therefore aims at overcoming the drawbacks of the prior art, by proposing a tooling and a method for manufacturing a wall with two concrete walls between which an insulation panel is trapped. The tooling and the method according to the invention allow the integration of at least one reinforcement in the walls of the concrete, while ensuring that the insulation panel and the reinforcement(s) are maintained in position during the concrete pouring operation. Advantageously, the tooling allows adjusting the position of the reinforcement(s) relative to the insulation panel, while maintaining them in position. In other words, the position of the reinforcement(s) can be adjusted using the tooling according to the invention, which guarantees a margin in the positioning of the reinforcement(s). Advantageously, the tooling is adapted to maintain in position reinforcements of different dimensions (for example more or less thick). The tooling according to the invention is therefore adapted to the laying conditions, and particularly to the different reinforcements that can be used, both because of their positioning and their size.

Another object of the invention is to propose a method for manufacturing a sandwich wall making it possible to obtain good mechanical resistance, and particularly retention, characteristics from one wall to the other. Advantageously, the method according to the invention is simple to implement, and particularly allows maintaining in position the reinforcement(s) in an easy manner adjustable to the position and to the size of the chosen reinforcements.

To achieve such an objective, the object of the invention relates to a tooling for manufacturing a wall with two concrete walls between which at least one insulation panel is trapped. This tooling includes at least one system for positioning the insulation panel composed, on the one hand, of a dagger having a rod provided with a bearing stop and, on the other hand, of a lock provided with a counter-stop. Said rod has a first end intended to be in contact with a first form panel and a second end intended to be in contact with a second form panel, so that the distance between the first and the second end is equal to the thickness of the wall. The lock is provided with at least two notches for receiving a first reinforcement, arranged locally on the circumference of the positioning system, extending set back from the first end of the rod, delimited on either side by retaining stops spaced apart so as to maintain in position the first reinforcement, defining a housing with a profile converging in the opposite direction to their opening, and arranged according to the length of the positioning system so as to be able to adjust the position of the first reinforcement according to the length of the positioning system. The housing with a profile converging in the opposite direction to the opening of the notches allows the tooling to adapt to the reinforcement, and particularly to different sizes of reinforcement.

The tooling according to the invention may further have, in combination with one or more of the following additional characteristics:

- the retaining stop(s) include a locking detent at the opening of the notch;
- the positioning system comprises a first hook extending radially set back from the first end of the rod, and delimiting a first retaining stop;
- the notches are of identical or different heights;
- the positioning system comprises a second hook, angularly orientable and extending set back from the second end of the rod, in order to maintain in position a second reinforcement;
- the distance between the bearing stop and the counter-stop, possibly in the presence of one or more compensating washers, is equal to the thickness of the insulator;
- the tooling includes devices for assembling the form panels together, each including a tubular spacer inside which a tightening rod provided at each end with a tightening member passes;
- the dagger includes assembly means between the lock and the dagger;
- the assembly means between the lock and the dagger include at least one lug arranged on the rod of the dagger and cooperating with a housing arranged on the lock after rotation thereof;
- the assembly means between the lock and the dagger are of the irreversible or repositionable type.

Another object of the invention relates to the implementation of the tooling according to the invention for the manufacture of a wall with two concrete walls between which at least one insulation panel is trapped and which include at least one reinforcement. The tooling according to the invention allows adjusting the positioning of the reinforcement whatever its size.

The invention relates to a method for manufacturing a wall with two concrete walls, between which at least one insulation panel is trapped, the walls being manufactured simultaneously or substantially simultaneously by pouring concrete between the insulation panel and a first form panel on the one hand, and between the insulation panel and a second form panel on the other hand, the form panels being disposed on either side of the insulation panel, a first reinforcement being placed on the side of the inner face of the first form panel, the insulation panel being held between the two form panels, before pouring the concrete, using positioning systems passing through the insulation panel and bearing on the inner faces of the form panels. The positioning system is composed, on the one hand, of a dagger having a rod provided with a bearing stop and, on the other hand, of a lock provided with a counter-stop. The method according to the invention comprises:

- placing on each insulation panel before their positioning, positioning systems each including at least two notches for receiving the first reinforcement, delimited on either side by retaining stops spaced apart so as to maintain in position the first reinforcement, extending set back from a first end of the rod, defining a housing with a profile converging in the opposite direction to its opening and arranged according to the length of the positioning system;
- placing each insulation panel with passage of the positioning systems through the first reinforcement, with possible rotation of said systems to ensure the engagement of the first reinforcement in the notches, and
- the adjustment of the positioning of the first reinforcement thanks to the presence of at least two receiving notches.

In addition, the method according to the invention may further have, in combination, at least one or both of the following additional characteristics:

- placing a second reinforcement on the side of the inner face of the second form panel, with possible rotation for the passage of at least one hook angularly orientable extending set back from a second end of the rod and their assembly with said second reinforcement,
- placing, on each insulation panel, the positioning systems by threading the rod of a dagger up to a bearing stop, a lock provided with at least one notch being assembled on the rod protruding from the insulation panel, when a counter-stop carried by the lock is bearing against the insulation panel, possibly in the presence of one or more compensating washer(s),
- maintaining in position the two form panels using assembly devices by placing, for each assembly device, before positioning the second form panel, a tubular spacer passing through the insulation panel and after positioning the second form panel, sealingly bearing on the inner faces of the form panels, each tubular spacer being traversed by a tightening rod extending outside the form panels to receive at each end a tightening member.

Various other characteristics will emerge from the description given below with reference to the appended drawings which show, by way of non-limiting examples, embodiments of the object of the invention.

Figure 1:
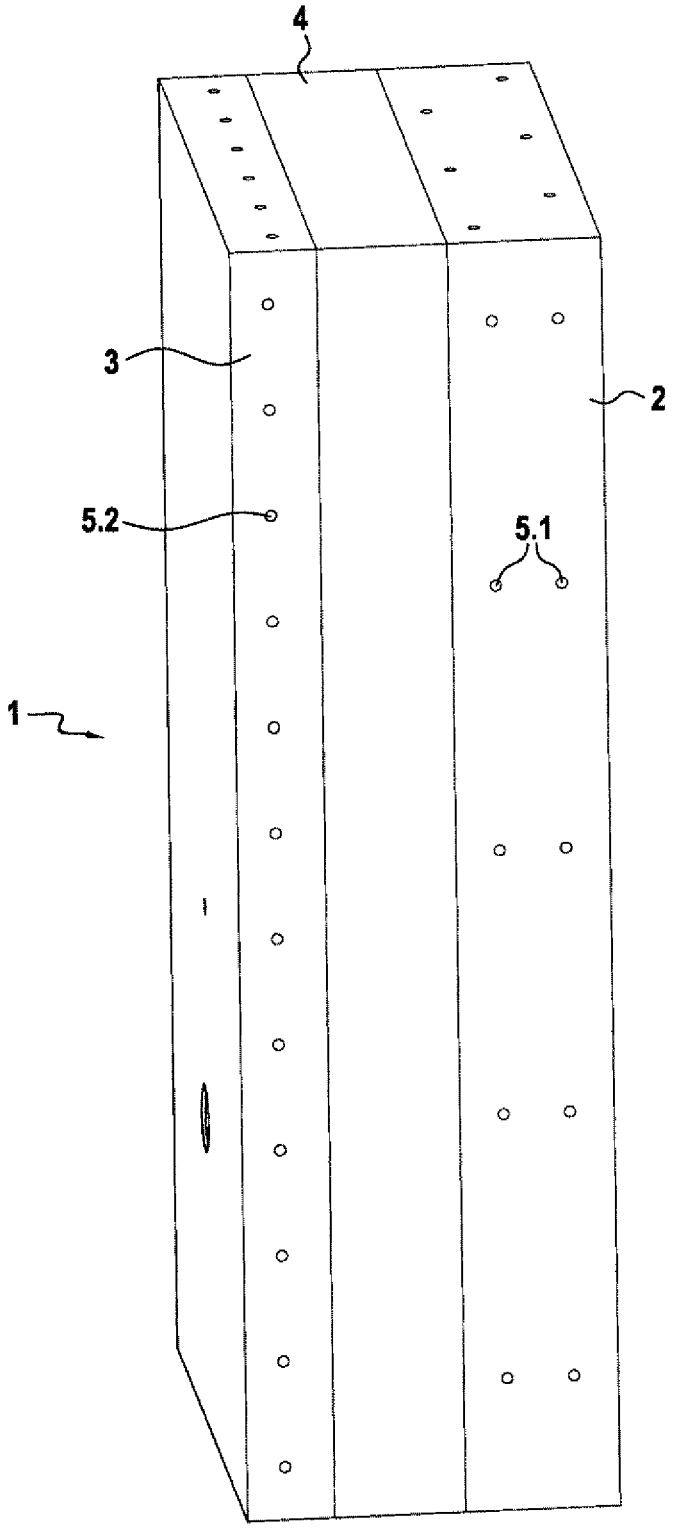
FIG. 1 is a perspective view showing a wall according to the invention manufactured by the method according to the invention.

As shown more precisely in FIG. 1, the object of the invention relates to a method allowing the manufacture of a wall 1 with two concrete walls 2, 3, between which at least one insulation panel 4 is trapped. The wall 1 thus includes a first concrete wall 2, and a second concrete wall 3 on either side of the insulation panel 4. In the example illustrated in FIG. 1, the two concrete walls 2, 3 are vertical and substantially parallel. This embodiment is however not limiting and the walls 2, 3 are not necessarily vertical and/or substantially parallel.

The insulation panel 4 is made of any thermal insulation material, such as, for example, of polystyrene.

The walls 2, 3 are manufactured simultaneously or substantially simultaneously, by pouring in situ of concrete between the insulation panel 4 and a first form panel 6 on the one hand, and between the insulation panel 4 and a second form panel 7 on the other hand. The form panels 6, 7 are disposed on either side of the insulation panel 4 and at a distance therefrom. The form panels 6, 7 are either inner or outer form panels. The first form panel 6 extends opposite a first face $\mathbf{4}_1$ of the insulation panel 4, parallel or non-parallel thereto, and at a determined distance therefrom corresponding to the thickness of the first wall 2, while the second form panel 7 extends opposite the outer face $\mathbf{4}_2$ of the insulation panel 4, parallel or non-parallel thereto, and at a determined distance therefrom corresponding to the thickness of the second wall 3.

The first wall 2 incorporates a reinforcement, called first reinforcement $\mathbf{5}_1$, of any type known per se. The first reinforcement $\mathbf{5}_1$ can be manufactured by one or more meshes or rebars placed before pouring the concrete, between the insulation panel 4 and the first form panel 6.

According to a preferred characteristic of embodiment, the second wall 3 also incorporates a reinforcement, called second reinforcement $\mathbf{5}_2$, of any known type, placed before pouring the concrete, between the insulation panel 4 and the second form panel 7. The two reinforcements $\mathbf{5}_1$ and $\mathbf{5}_2$ can be identical or different, and are advantageously of the same nature.

The method according to the invention is implemented using a suitable tooling including positioning systems 8 allowing to maintain the insulation panel 4 and the reinforcement 5 between the form panels 6, 7 and possibly to maintain the assembly devices 9 of the form panels 6, 7 together, independently of the positioning systems 8.

Each positioning system 8 includes in the exemplary embodiment illustrated in FIGS. 2 to 4 and 6, a first part such as a dagger 10 on which a second part such as a lock 11 is intended to be assembled.

The dagger 10 includes a rod 12 intended to be inserted through the insulation panel 4 from one of the faces $\mathbf{4}_1$, $\mathbf{4}_2$ of the insulation panel 4. The rod 12 includes a first end $\mathbf{12}_1$ extending opposite a second end $\mathbf{12}_2$. The rod 12 is intended to bear through its ends $\mathbf{12}_1$, $\mathbf{12}_2$, against the inner faces of the form panels 6, 7. The rod 12 has a length equal to the thickness of the manufactured wall 1. According to a preferred variant, the rod 12 can have, from one of its ends, and preferably from its two ends, sectionable portions which are precut or predefined that allow adjusting the length of the rod 12 to the thickness of the wall 1 to be manufactured. According to another variant, a family of daggers 10 can be manufactured including rods 12 of different lengths, thus making it possible to manufacture walls of different thicknesses.

The rod 12 is provided with a bearing stop 13 placed in the vicinity of the second end $\mathbf{12}_2$ to come into contact with the second face $\mathbf{4}_2$ of the insulation panel 4. For example, the bearing stop 13 is manufactured in the form of a disc extending transversely with respect to the rod 12. This bearing stop 13 is distant from the second end $\mathbf{12}_2$ of the rod 12 according to a distance corresponding to the thickness of the second wall 3. The adjustment of the length of the rod 12 from the second end $\mathbf{12}_2$ allows adapting to the thickness of the second wall 3.

The width between the second end $\mathbf{12}_2$ of the rod 12 and the second face $\mathbf{4}_2$ of the insulation panel 4 can be adjusted using one or more washers threaded on the rod 12 from the first end $\mathbf{12}_1$, until it comes into contact on the bearing stop 13. Placing these washers makes it possible to move the bearing for the insulation panel 4 away from the second end $\mathbf{12}_2$. Preferably, the rod 12 has from the bearing stop 13, longitudinal slots arranged on the periphery of the rod 12 up to the first end $\mathbf{12}_1$ which has a bevelled shape to facilitate the passage through the insulation panel 4.

The lock 11 is in the form of a tubular sleeve 15 intended to be threaded on the rod 12 from its first end $\mathbf{12}_1$. This tubular sleeve 15 is provided with a counter-stop 16 intended to bear on the first face $\mathbf{4}_1$ of the insulation panel 4. In the example illustrated, the counter-stop 16 is in the form of a disc extending transversely or radially from the proximal end of the tubular sleeve 15.

Figure 2:
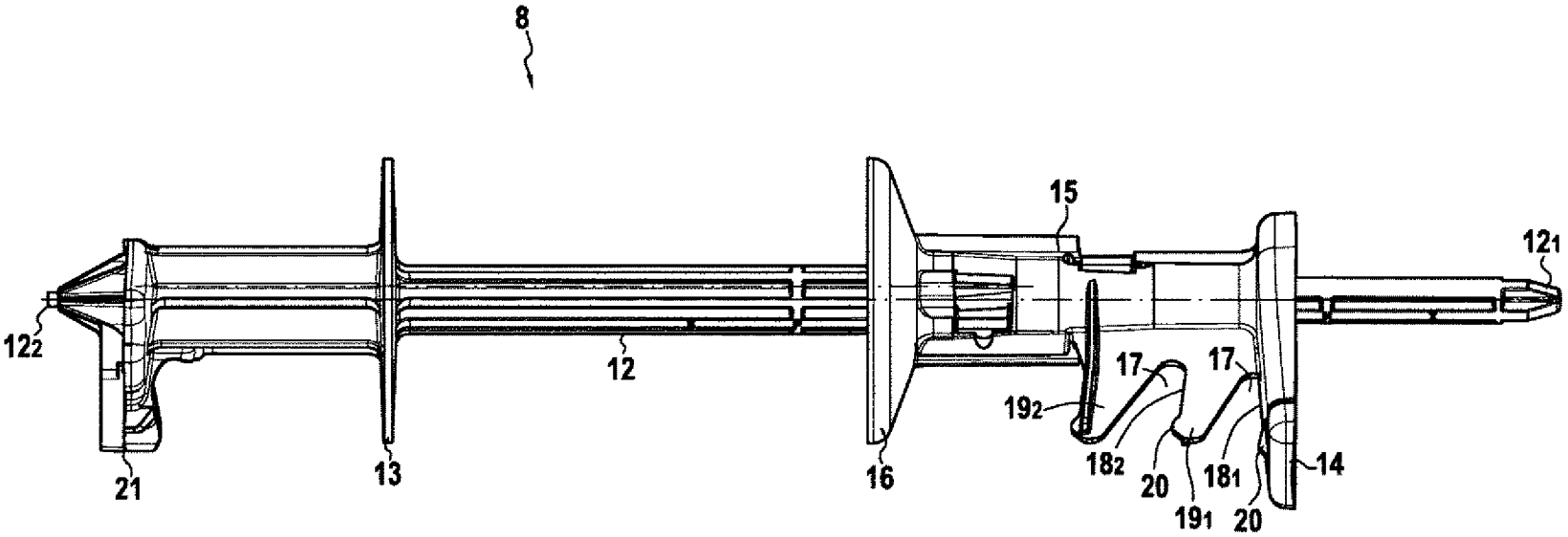
FIG. 2 is a side view of a positioning system according to the invention.
Figure 3:
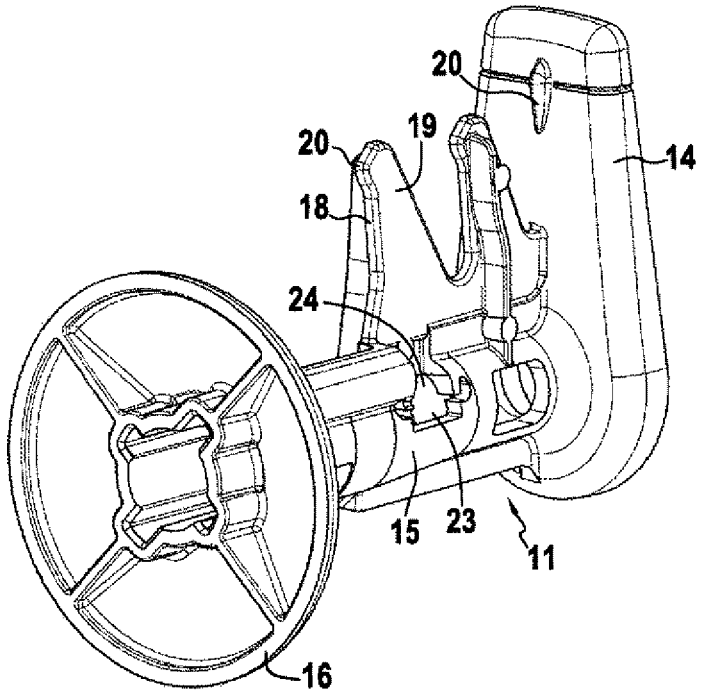
FIG. 3 is a perspective view of an embodiment of the lock of a positioning system according to the invention.

The lock 11 also includes a first hook 14 extending radially set back from the first end $\mathbf{12}_1$ of the rod 12, and for example from the distal end of the tubular sleeve 15, as represented in FIG. 2. In the illustrated exemplary embodiment, the first hook 14 is in the form of a plate of substantially rectangular shape, of limited angular width of the order of ten degrees, extending perpendicularly to the rod 12 and protruding from the tubular sleeve 15.

The lock 11 also includes at least two notches 17, or groove or indentation, for receiving a first reinforcement $\mathbf{5}_1$, adapted to cooperate with the first reinforcement $\mathbf{5}_1$. The notches 17 are delimited on either side by retaining stops 18, spaced apart so as to maintain and block in position the first reinforcement $\mathbf{5}_1$. The notches are arranged locally on the circumference of the tubular sleeve 15 of the positioning system 8 and extend set back from the first end $\mathbf{12}_1$ of the rod 12.

More precisely, the lock 11 includes at least one notch $\mathbf{17}_1$ delimited on either side by two retaining stops $\mathbf{18}_1$ and $\mathbf{18}_2$, respectively delimited by the sides of the first hook 14 and of a first wing or spine $\mathbf{19}_1$. The first wing or spine $\mathbf{19}_1$ is arranged locally on the circumference of the tubular sleeve 15 of the positioning system 8, and extends radially set back from the first hook 14 according to the length of the positioning system 8, one behind the other.

Advantageously, each notch 17 defines a housing for the first reinforcement $\mathbf{5}_1$, with a profile which, according to the length of the positioning system 8, is converging in the opposite direction to its opening. In other words, each notch 17 has a triangular-shaped housing. This geometry allows each notch to cooperate with reinforcements of different sizes.

The first retaining stop $\mathbf{18}_1$ is advantageously substantially perpendicular to the rod 12. The second retaining stop $\mathbf{18}_2$ is advantageously oblique with respect to the rod 12 while being oriented in the direction of the first hook 14. This geometry advantageously makes it possible to optimize the blocking in position of the first reinforcement $\mathbf{5}_1$ during the concrete pouring operation.

The lock 11 may include several, in particular two, three or four, receiving notches 17 arranged one behind the other according to the length of the tubular sleeve 15 by the incorporation of wings or spines 19. According to one particular embodiment represented in FIGS. 2 and 3, the lock 11 includes two notches 17 for receiving a first reinforcement $5_1$, thanks to the presence of the first hook 14 and of two wings $19_1$ and $19_2$.

The receiving notches 17 are arranged according to the length of the positioning system 8. It is then possible to adjust the position of the first reinforcement $5_1$, thanks to the choice of the notch 17 in which the first reinforcement $5_1$ will be maintained. The different notches can be of identical or different dimensions, and particularly of identical or different height. The wings or spines 19 have preferably a triangular shape, as is illustrated in particular in the exemplary embodiment of FIG. 2.

The wings or spines 19 as well as the first hook 14 include a locking detent 20 at the opening of the notch, in order to avoid any movement of the reinforcement during the concrete pouring operation, More specifically, each notch 17 includes a locking detent 20 on one of the stops delimiting it, and preferably on the end of the stop corresponding to the opening of the notch. Each locking detent is preferably located on a retaining stop 18 obliquely to the rod 12 and oriented in the direction of the first hook 14.

Figure 4:
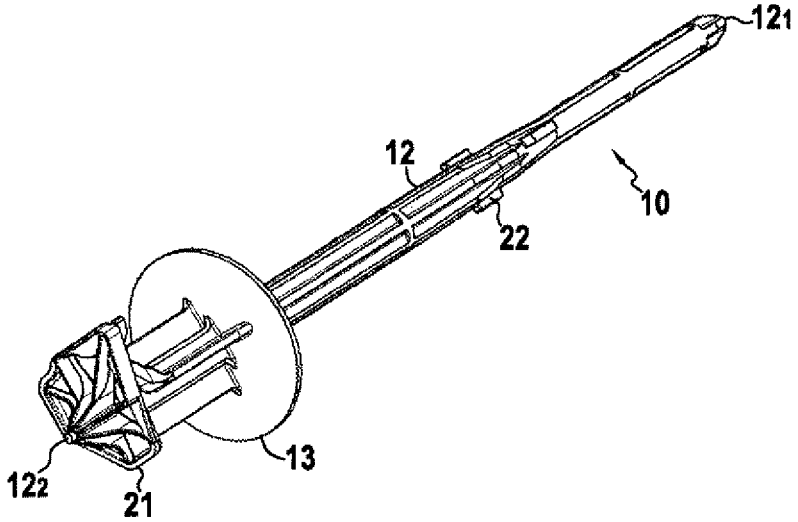
FIG. 4 is a perspective view illustrating a dagger of a positioning system according to the invention.

According to one embodiment, the dagger 10 includes a second hook 21 adapted to cooperate with a second reinforcement $5_2$. The second hook 21 thus extends radially set back from the second end $12_2$ of the rod 12, and for example from the bearing stop 13 as represented in FIG. 4. In the illustrated exemplary embodiment, the second hook 21 is in the form of a plate of substantially rectangular shape, of limited angular width of the order of ten degrees, and extends protruding from the rod 12. The second hook 21 is angularly orientable, and thus allows maintaining in position the second reinforcement $5_2$ during the concrete pouring operation.

The lock 11 and the dagger 10 include assembly means making it possible to fix the lock 11 on the rod 12 in a fixed position along the rod 12, such that the bearing stop 13 and the counter-stop 16 are respectively bearing on the faces $4_1$, $4_2$ of the insulation panel 4. In the exemplary embodiment illustrated in FIGS. 3 and 4, the assembly means include at least one lug 22 carried by the rod 12 and intended to cooperate with at least one complementary housing 23 arranged on the tubular sleeve 15. The housing 23 opens laterally in a slot 24 arranged in the tubular sleeve 15 up to the proximal end of the tubular sleeve 15. In other words, the slot 24 opens into the housing 23 which has, in an angularly offset manner, a shape complementary to the lug 22 to ensure its blocking in translation along the axis of the rod 12.

The lug 22 is positioned on the rod 12 such that in the position of cooperation with the housing 23 of the lock 11, the distance between the bearing stop 13 and the counter-stop 16 corresponds to the thickness of the insulation panel 4. According to a preferred variant, the assembly means are adapted to allow adjusting the distance between the bearing stop 13 and counter-stop 16. According to this variant, the rod 12 is provided with a series of lugs 22 distributed over the length of the rod 12 to correspond to various conventional thicknesses of the insulation panel 4. These lugs 22 are also distributed angularly on the periphery of the rod 12 so as to be able to each penetrate into a corresponding slot 24 arranged on the lock 11. The lock 11 thus includes as many slots 24 and housings 23 as lugs 22, these slots 24 being angularly offset together by a value equal to the angular offset presented by the lugs 22 on the rod 12. This dagger 10 and this lock 11 allow being used for various thicknesses of the insulation panel 4 by choosing the cooperation of the suitable lug with its corresponding housing.

In practice, the lock 11 is engaged on the rod 12 by engaging the tubular sleeve 15 through its proximal end from the first end $12_1$ of the rod 12, while making each slot 24 angularly coincide with a lug 22. The lock 11 is slid closer to the bearing stop 13 until bearing against the first face $4_1$ of the insulation panel 4. In this position, at least one lug 22 opens into a housing 23 so that a relative rotation between the lock 11 and the rod 12 leads to the blocking of the lug 22 in the complementary housing 23, thus preventing any translation or sliding movement of the lock 11 on the rod 12. In this position, the insulation panel 4 is provided with one or more positioning systems 8.

The assembly means 22, 23, 24 between the lock 11 and the dagger 10 are of the irreversible or repositionable type.

When the assembly means 22, 23, 24 between the lock 11 and the dagger 10 are of the irreversible type, irreversibility means 25 prohibit the relative rotation in an opposite direction between the lock 11 and the rod 12 after the assembly between the lock 11 and the dagger 10 obtained following the relative rotation between the lock 11 and the rod 12. These irreversibility means 25 allow effective blocking in position between the lock 11 and the rod 12. By way of example, these irreversibility means 25 are manufactured by elastically deformable fingers adapted to be deformed by the lugs 22 during the rotational movement of the lugs 22 bringing them into the housings 23. When the deformable fingers are no longer loaded by the lugs 22, these return to their initial position ensuring the blocking of the lugs 22 inside the housings 23, preventing their rotation in a direction leading them to leave the housings 23.

Figure 5:
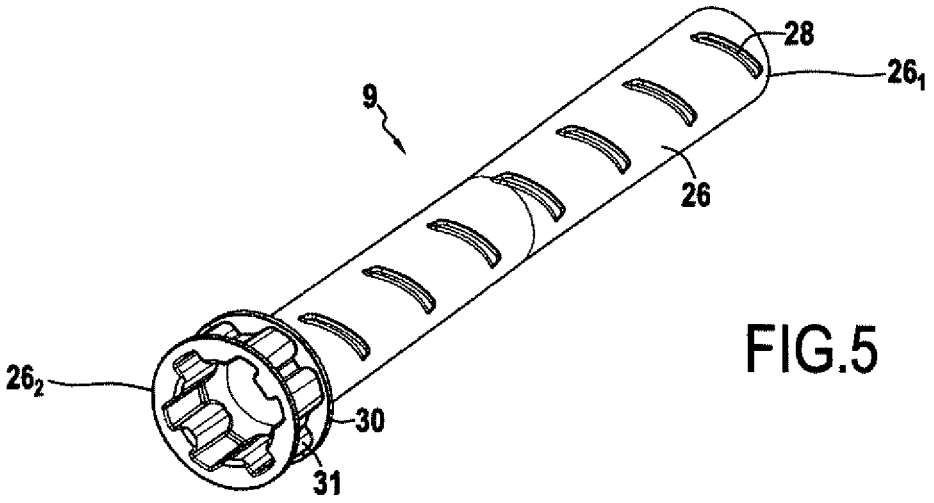
FIG. 5 is a perspective view showing an exemplary embodiment of an assembly device according to the invention.

FIG. 5 illustrates an exemplary embodiment of an assembly device 9 according to the invention, including a tubular spacer 26 delimiting internally a bore 27. This tubular spacer 26 is intended to penetrate into the insulation panel 4, from its second face $4_2$ and bear against the inner faces of the form panels 6, 7. The tubular spacer 26 has, relative to its direction of penetration into the insulation panel 4, a downstream end $26_1$ and an upstream end $26_2$. The tubular spacer 26 is externally provided with sharp or cutting elements 28 adapted to cut the insulation panel 4 during the mounting of the tubular spacer 26 in the insulation panel 4 by a rotational movement of the tubular spacer 26. For example, the cutting elements 28 are distributed helically or in a screw pitch facilitating its penetration into the insulation panel 4 engaged along its downstream end $26_1$.

According to an advantageous characteristic of embodiment, the downstream end $26_1$ of the tubular spacer 26 includes penetration assistance teeth 29 making it possible to initiate the operation of cutting the insulation panel 4. Advantageously, the teeth 29 are adapted to crush against the inner face of the first form panel 6 or of the second form panel 7, contributing to the sealing between the form panel 6 or 7 and the tubular spacer 26.

According to another advantageous characteristic of embodiment, the tubular spacer 26 includes at its upstream end $26_2$, a peripheral flange 30 of deformable nature intended to crush by tightening in order to ensure sealing between the other form panel 6 or 7 and the tubular spacer 26.

According to a particular characteristic of embodiment, the tubular spacer 26 includes at its upstream end also a gripping member 31, such as a disc, extending transversely to the length of the tubular spacer 26. Preferably, this gripping member includes at its periphery, a detent in order to facilitate its handling in particular during its insertion in the insulation panel 4.

Advantageously, the bore 27 of the tubular spacer 26 includes from its upstream end $\mathbf{26}_2$, a prismatic shape making it possible to cooperate with an operating or screwing tool facilitating the operation of penetration into the insulation panel 4.

According to an advantageous variant, the tubular spacer 26 includes at each end a removable ring. Thus, one of the removable rings includes the teeth 29 while the other removable ring includes the peripheral flange 30 and a prismatic shape for the handling. These rings are mounted for example by interlocking, at each end of the tubular spacer 26. These rings have an external shape in relief allowing their removal, relative to the spacer and to the concrete walls 2, 3, after their formation.

The assembly device 9 also includes a tightening rod (not illustrated) that would pass inside the bore 27 and pass through the form panels 6 and 7. This tightening rod would protrudes on either side of the form panels 6 and 7 to allow a screwing of tightening members (not illustrated) such as nuts.

The method for manufacturing a wall 1 stems directly from the description above.

The method according to the invention consists in equipping the insulation panel 4 with one or more positioning systems 8 according to the invention.

As apparent more specifically from FIGS. 6A to 6G, the method consists in engaging the rod 12 through its first end $\mathbf{12}_1$ in the insulation panel 4 until the bearing stop 13 comes into contact directly (or via one or more added compensating washers, not represented in the figures), with the outer face $\mathbf{4}_2$ of the insulation panel 4. In this position, the rod 12 is protruding relative to the inner face $\mathbf{4}_1$ of the insulation panel 4. The lug(s) 22 are thus located on the side of the inner face $\mathbf{4}_1$ of the insulation panel 4. The method according to the invention then consists in ensuring the mounting of the lock 11 on the rod 12 protruding from the face $\mathbf{4}_1$ of the insulation panel 4. The tubular sleeve 15 of the lock 11 is threaded on the rod 12 from its first end $\mathbf{12}_1$, As can be seen more specifically in FIG. 66, the lock 11 is translated such that the counter-stop 16 bears with the inner face $\mathbf{4}_1$ of the insulation panel 4. During this translation, the lock 11 is angularly oriented such that a lug 22 slides in a complementary slot 24. When the counter-stop 16 is bearing on the inner face $\mathbf{4}_1$ of the insulation panel 4, the lock 11 is turned angularly relative to the rod 12 so as to bring the lug 22 in the complementary housing 23 to allow the locking of the lock 11 in a fixed position on the rod 12. At the end of the mounting operation, the dagger 10 and the lock 11 are assembled by a complete connection.

Independently of the mounting of the positioning system 8 and of the assembly device 9, the method for manufacturing a wall consists in placing the first form panel 6 in situ to manufacture the wall 1. Of course, the first form panel 6 is placed in a conventional manner by any known bracing equipment or tool which will not be described more specifically in the following description. In the same sense, the following description describes the manufacture of a wall using two form panels 6, 7 but it is clear that, in a conventional manner, the walls require the manufacture of a first and a second framework implementing in particular a series of first and second form panels placed side by side according to a bed or two superimposed beds depending on the height of the wall to be manufactured. This placing technique is not described more specifically because it uses conventional construction techniques well known to those skilled in the art. Conventionally, each form panel 6, 7 includes through holes respectively $\mathbf{6}_1$, $\mathbf{7}_1$ for the passage of a tightening rod.

Figure 6A:
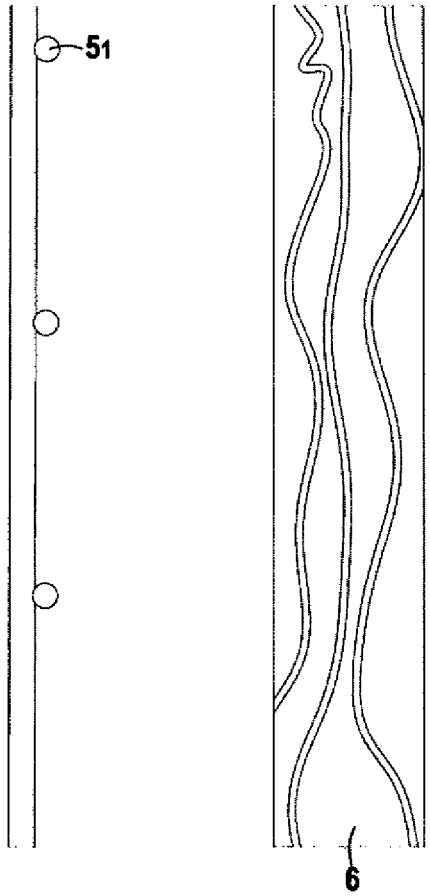
FIGS. 6A to 6G illustrate successive steps of a method for manufacturing a wall according to the invention.
Figure 6B:
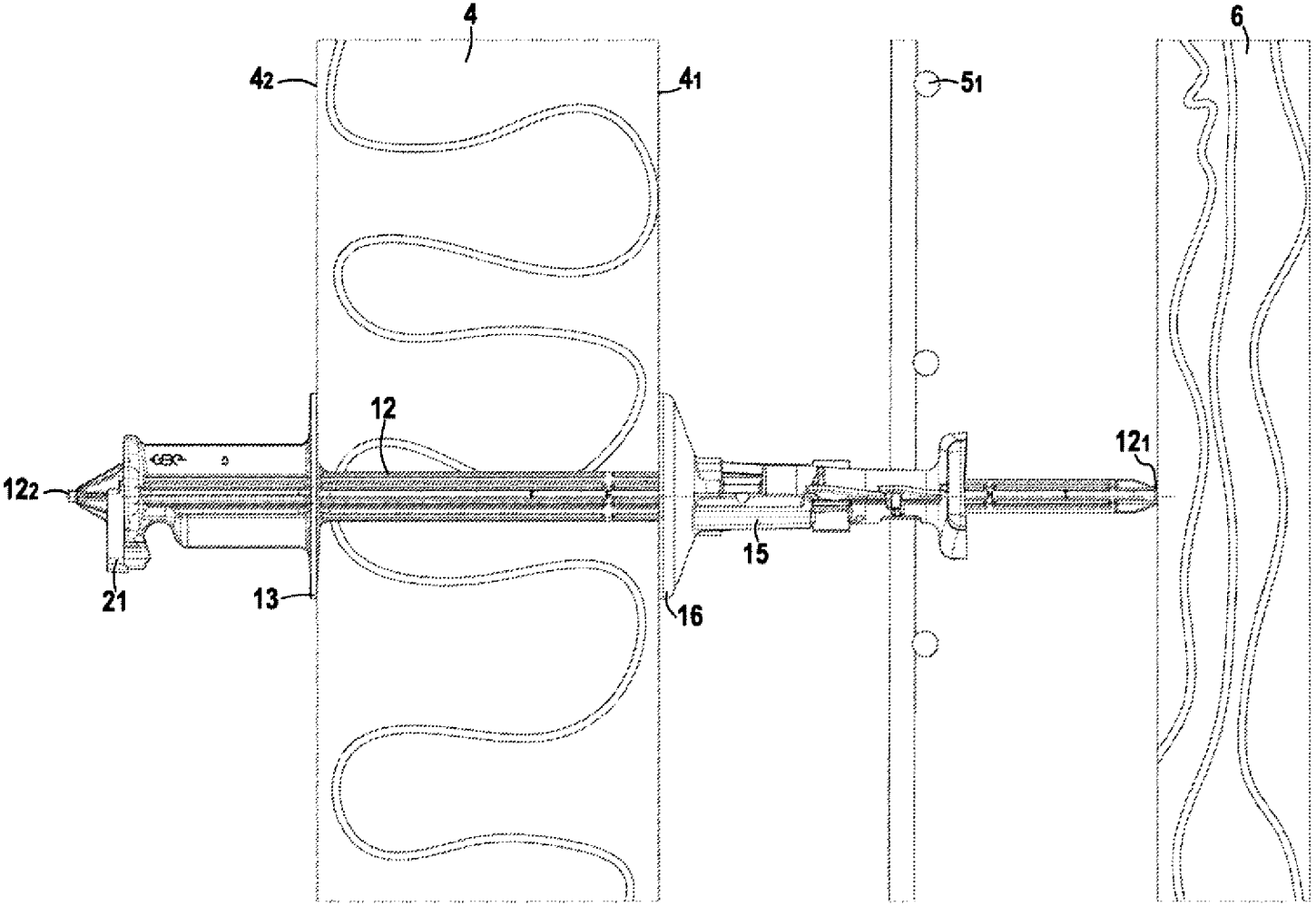

The method according to the invention consists, as illustrated in FIG. 6A, of placing a first reinforcement $\mathbf{5}_1$ relative to the first form panel 6. Placing this first reinforcement $\mathbf{5}_1$ is not described more specifically because it is well known to those skilled in the art. In the same sense, the reservation dummy bars for the openings or frames to be shuttered are positioned on the first form panel 6 before placing the first reinforcement $\mathbf{5}_1$.

The method according to the invention then consists in positioning the insulation panel 4 relative to the first form panel 6 in front of which the first reinforcement $\mathbf{5}_1$ is positioned. As seen from FIG. 6B, the insulation panel 4 is positioned so as to allow the abutment of the first end $\mathbf{12}_1$ of the rod 12 bearing on the inner face of the first form panel 6 and to allow the first hook 14 to pass through the first reinforcement $\mathbf{5}_1$ with a view to cooperation between the first reinforcement $\mathbf{5}_1$ and the first hook 14 after the operation of blocking the first reinforcement $\mathbf{5}_1$ thanks to the positioning system 8.

Figure 6C:
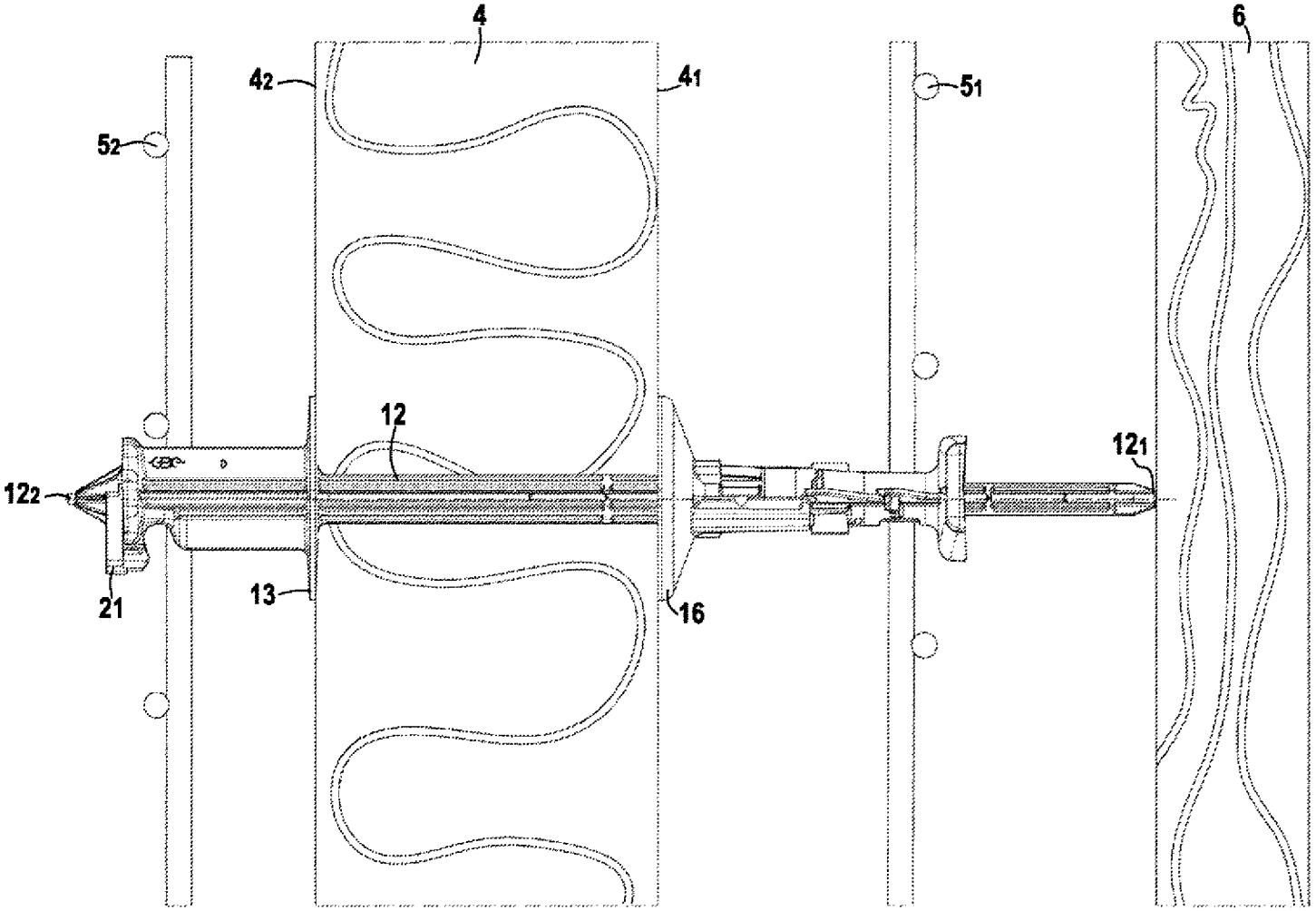

The method according to the invention then consists in placing a second reinforcement $\mathbf{5}_2$ on the side of the second face $\mathbf{4}_2$ of the insulation panel 4, as illustrated in FIG. 6C, according to techniques well known to those skilled in the art. The second reinforcement $\mathbf{5}_2$ then passes through the second reinforcement $\mathbf{5}_2$ and is positioned so as to cooperate with the second hook 21 after the operation of blocking the second reinforcement thanks to the positioning system 8.

Figure 6D:
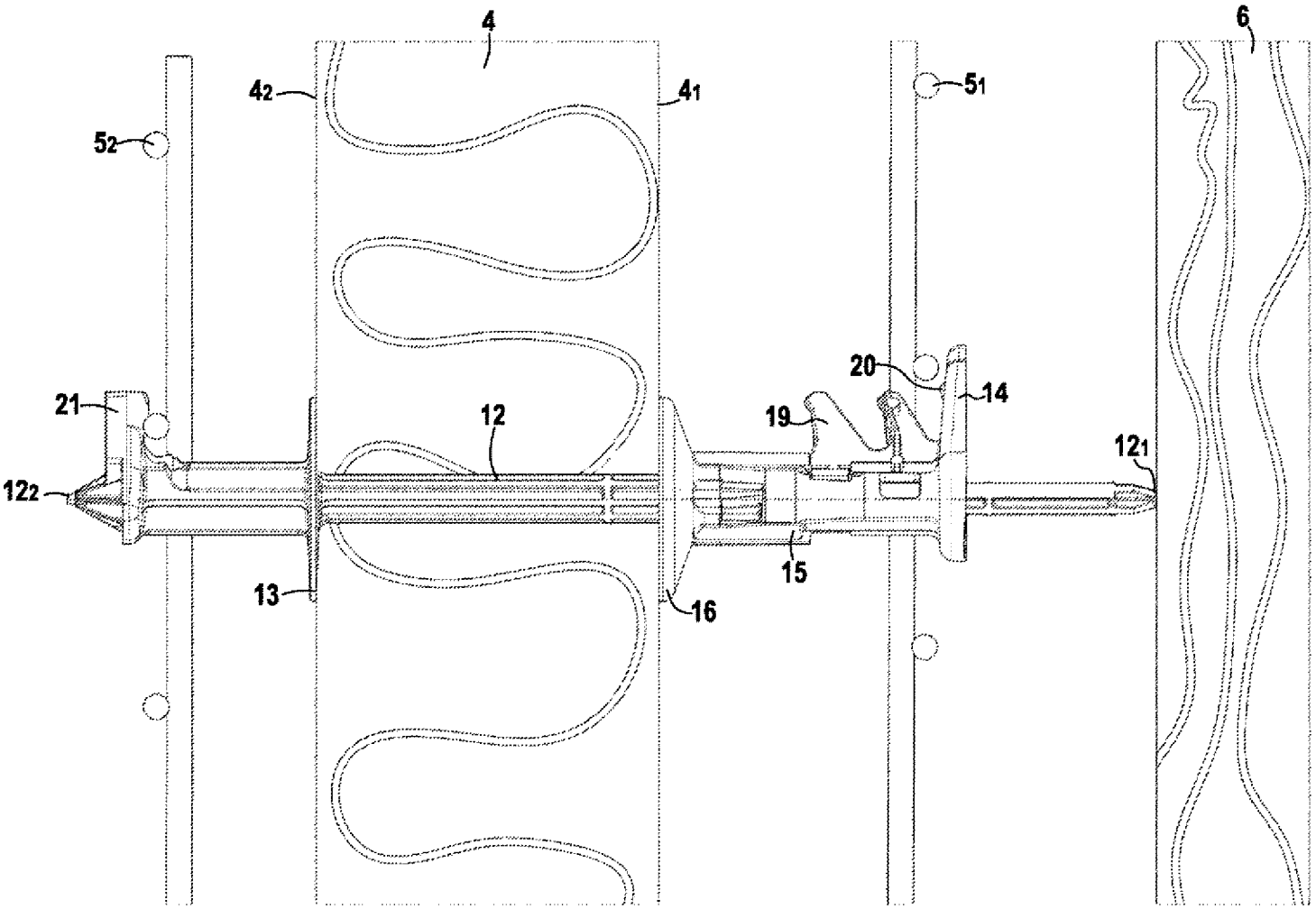
Figure 7:
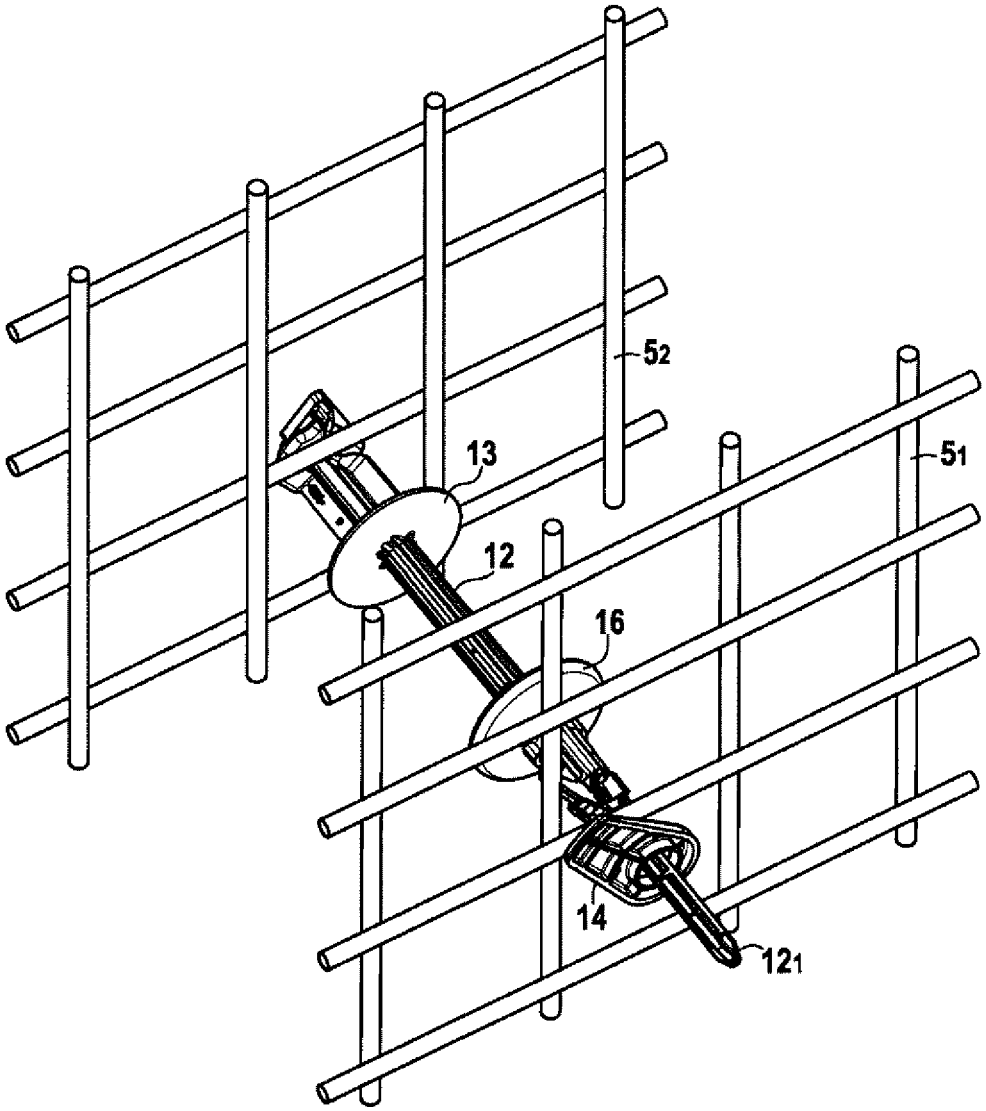
FIG. 7 is a perspective view showing the mounting of a positioning system through reinforcements.

The rod 12 is then turned using an operating handle to allow the notch 17 and the second hook 21 to cooperate respectively with the first reinforcement $\mathbf{5}_1$ and the second reinforcement $\mathbf{5}_2$, as represented in FIGS. 6D and 7, and thus allow the blocking in position of the reinforcements $\mathbf{5}_1$ and $\mathbf{5}_2$. The positioning system 8 thus ensures, by means of the notch 17 and of the second hook 21, an assembly of the insulation panel 4 relative to the first and to the second reinforcement $\mathbf{5}_1$, $\mathbf{5}_2$ and a positioning relative to the first form panel 6. Since the lock 11 includes several notches 17, the choice of the notch through which the reinforcement will be maintained makes it possible to adjust the position of the first reinforcement relative to the first face $\mathbf{4}_1$ of the insulation panel 4.

The method according to the invention then consists in placing the devices for assembling 9 the form panels 6, 7, by placing one or more tubular spacers 26 intended to be established between the two form panels 6, 7. The method according to the invention therefore consists in placing each tubular spacer 26 in alignment with a hole $\mathbf{6}_1$ arranged in the first form panel 6. According to an advantageous variant, it can be envisaged to pass through the hole $\mathbf{6}_1$ and the insulation panel 4 a needle opening on the side of the outer face $\mathbf{4}_2$ of the insulation panel 4 so as to locate the axis of a hole $\mathbf{6}_1$ of the first form panel 6. The tubular spacer 26 is then threaded on the end of the needle protruding from the outer face $\mathbf{4}_2$ of the insulation panel 4 to come, through its downstream end, into contact with the insulation panel 4. The rotation of the tubular spacer 26 leads to its penetration thanks to the sharp elements 28 inside the insulation panel 4. After passing through the insulation panel 4, the tubular spacer 26 abuts, through its downstream end $\mathbf{26}_1$, against the inner face of the first form panel 6. In this position, after removal of the pre-positioning needle, a tightening rod is threaded through the hole $\mathbf{6}_1$ of the first form panel 6 and of the bore 27 of the tubular spacer 26 thus getting rid of the sprue of the insulation panel 4 manufactured by the tubular spacer 26.

Figure 6E:
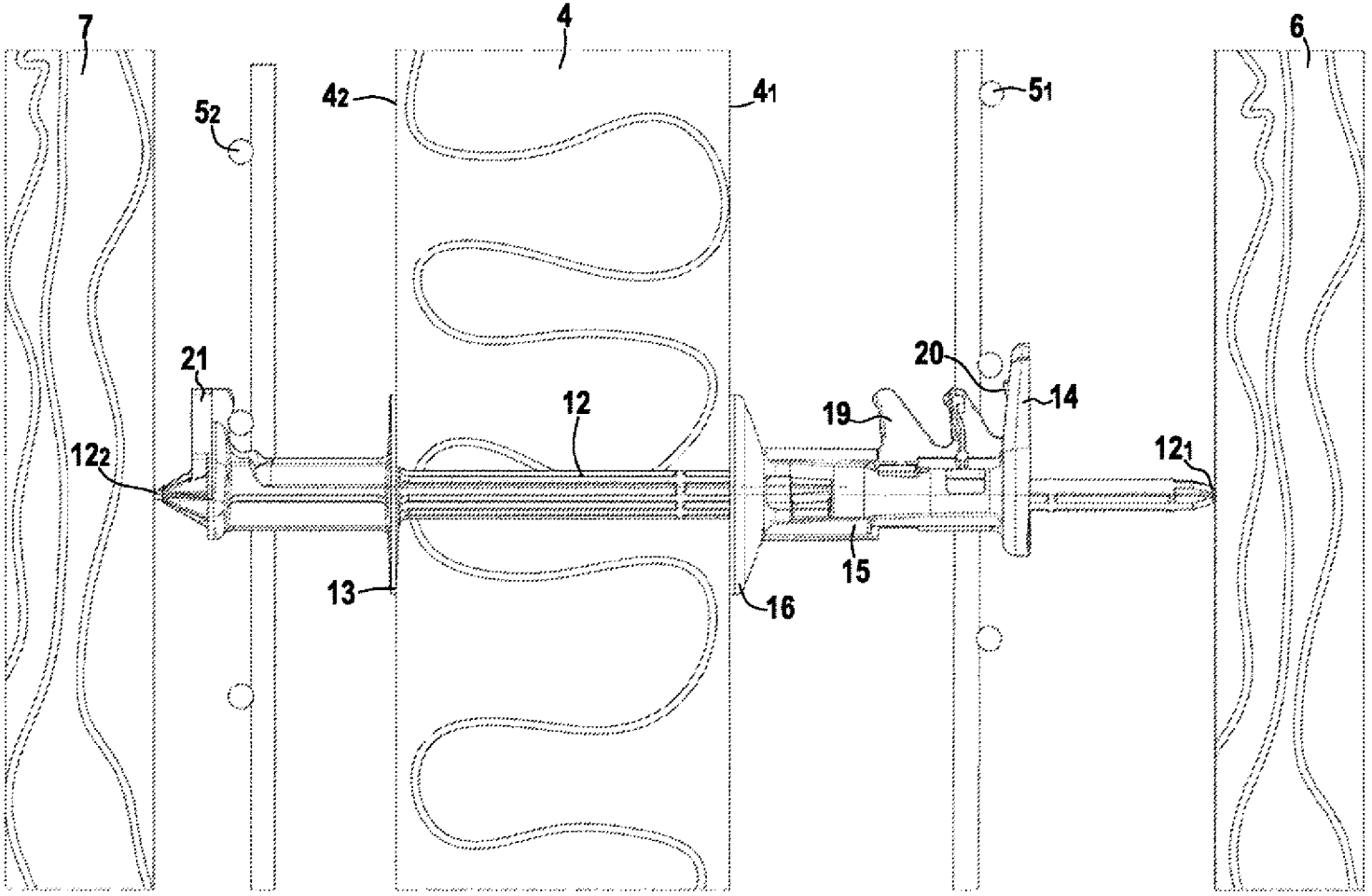

The method according to the invention then consists in placing the second form panel 7 to bear on the upstream end $\mathbf{26}_2$ of the tubular spacer 26 (FIG. 6E). During this operation, a tightening rod is engaged inside a passage hole $\mathbf{7}_1$ arranged in the second form panel 7. In this position, the tightening rod completely passes through the form panels 6, 7 and the insulation panel 4 by extending on either side of the form panels 6, 7. The tightening rod is then used for the mounting of tightening members such as nuts, making it possible to ensure blocking in position the form panels 6, 7 together. It should be noted that during this operation, the tightening of the nuts allows ensuring a localized deformation of the downstream $\mathbf{26}_1$ and upstream $\mathbf{26}_2$ ends of the tubular spacer 26 so as to ensure a sealing between this tubular spacer 26 and the form panels 6, 7.

Figure 6F:
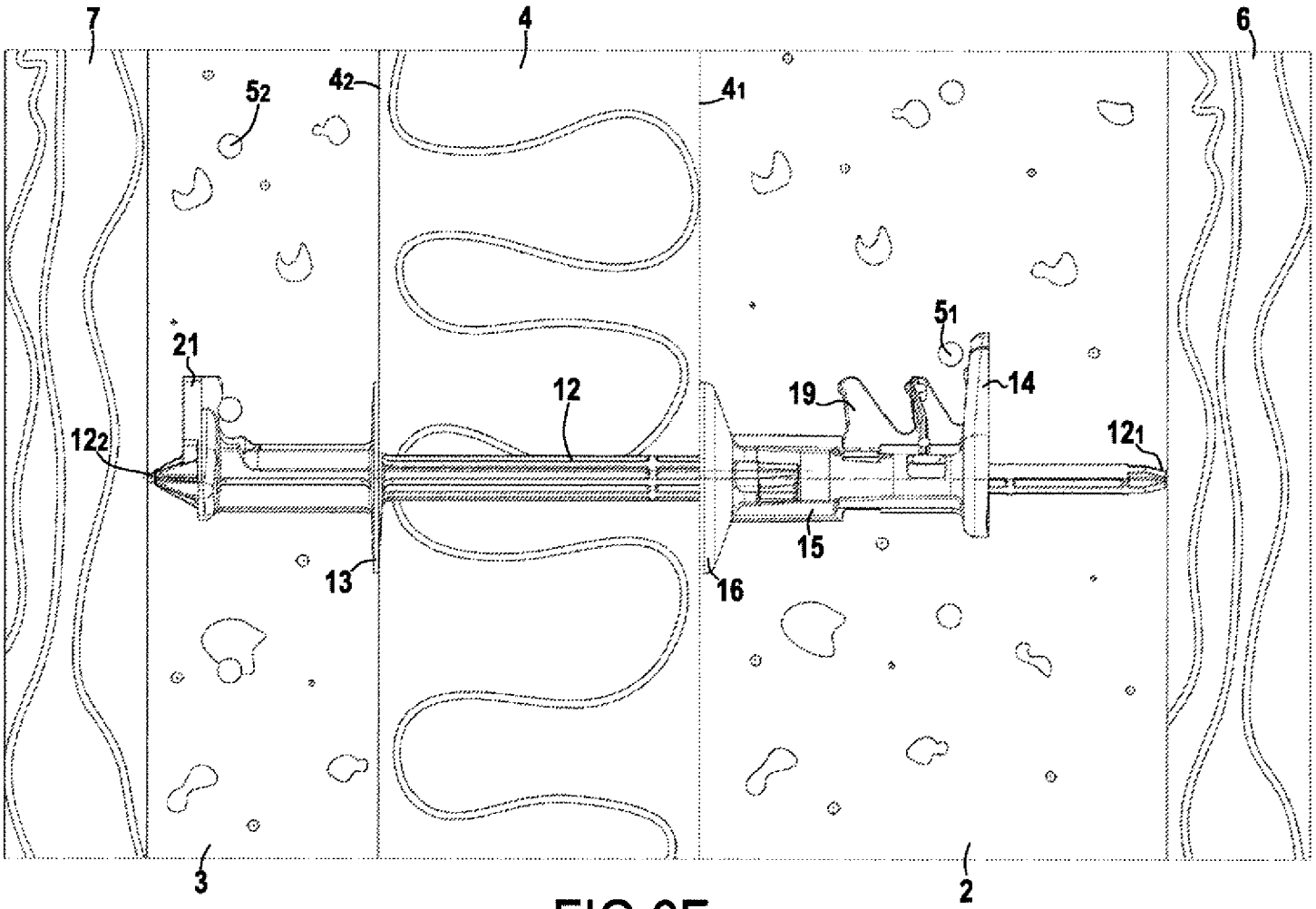
Figure 6G:
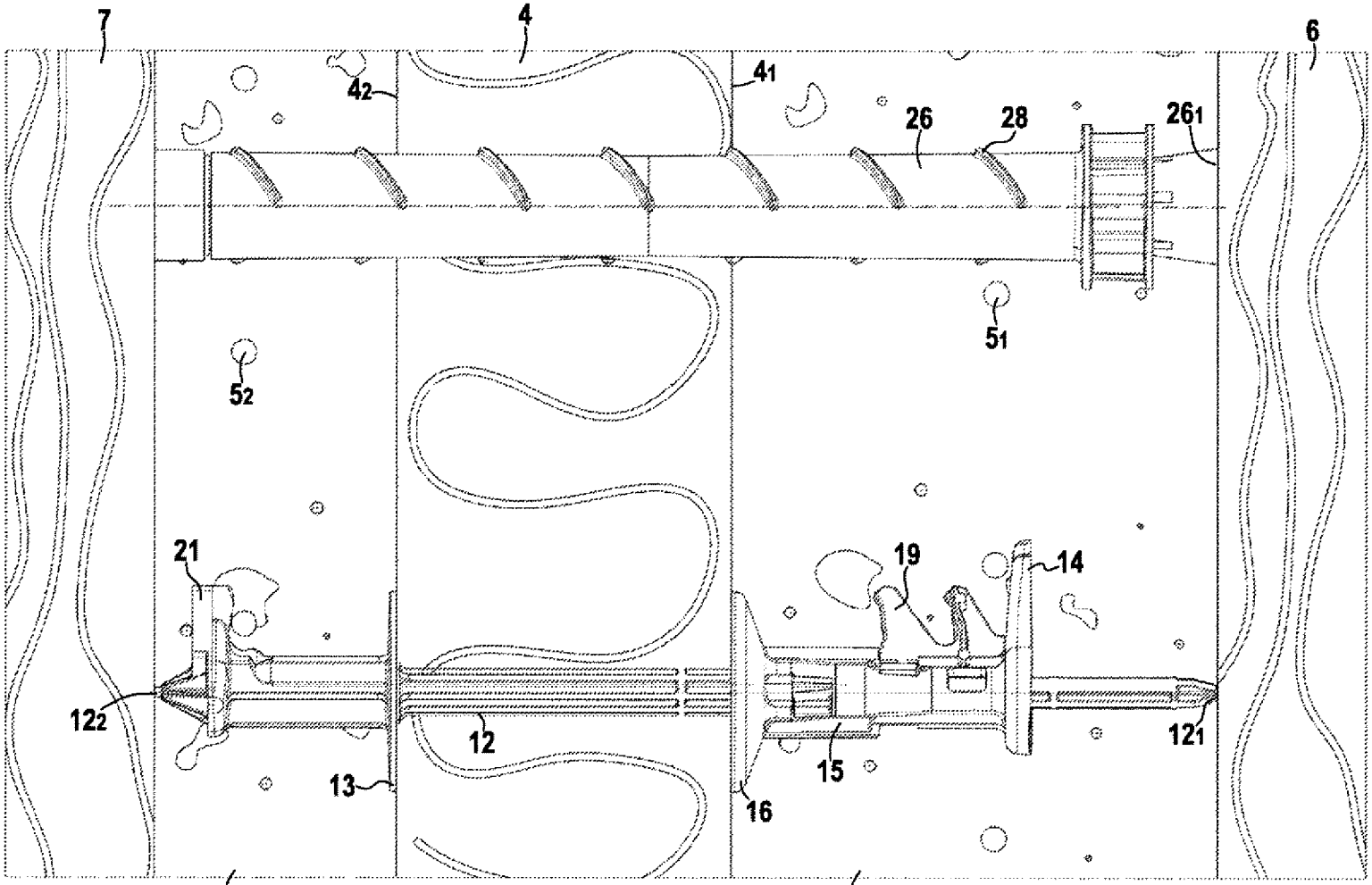

Insofar as the internal framework and the outer framework are manufactured, it is possible to consider the concreting operation aimed at ensuring the simultaneous or substantially simultaneous injection of the concrete between the insulation panel 4 and the form panels 6, 7 in order to simultaneously or substantially simultaneously manufacture the walls 2 and 3 (FIGS. 6F and 6G). The concrete can be poured either from the upper portion of the form panels or preferably from the lower portion of the framework. For example, the injection nozzles are placed at the bottom portion of the form panels 6 and 7 placed opposite each other so as to allow the pouring of the concrete from the bottom portion of the form panels. Taking into account the placing of the positioning systems 8, the insulation panel 4 and the reinforcements $\mathbf{5}_1$ and $\mathbf{5}_2$ remain in place during the pouring of the concrete. Particularly, the insulation panel 4 and the reinforcements $\mathbf{5}_1$ and $\mathbf{5}_2$ are not lifted during the operation of simultaneous pouring of concrete between the form panels 6, 7 and the insulation panel 4.

After solidification of the concrete, the method according to the invention then consists in removing the tightening rod by loosening the tightening members and in removing the form panels 6, 7. It should be noted that in the case where the tubular spacers 26 are provided with rings removable at their ends, these removable rings are removed so that the tubular spacers which remain in place are no longer flush with the outer faces of the walls 2, 3. The manufactured wall 1 thus incorporates the assembly devices 9 and the positioning systems 8 which, mounted independently of one another, thus ensure in combination a mechanical retention of the second wall 3 relative to the first wall 2. The wall thus built has good mechanical resistance characteristics.

In the exemplary embodiment illustrated in FIGS. 6A to 6F and detailed above, the positioning system is placed so that the first end $\mathbf{12}_1$ of the rod bears against the inner face of the first form panel 6, and the second end $\mathbf{12}_2$ of the rod bears against the inner face of the second form panel 7. This embodiment is not limiting, and the positioning system can also be placed so as the first end $\mathbf{12}_1$ of the rod bears against the inner face of the second form panel 7, and the second end $\mathbf{12}_2$ of the rod bears against the inner face of the first form panel 7.

The method according to the invention thus allows manufacturing, relatively easily in situ, a sandwich wall directly integrating the thermal insulation between two concrete walls manufactured simultaneously.

In the description above, the positioning systems 8 are made of plastic material such as polymer. According to this variant, the dagger 10 and the lock 11 are manufactured by molding. Similarly, the tubular spacer 26 is made of plastic material such as polymer.

The invention is not limited to the examples described and represented since various modifications can be made thereto without departing from its scope.

The invention claimed is:

1. A tooling for manufacturing a wall (1) with two concrete walls (2, 3) between which at least one insulation panel (4) is trapped, this tooling including at least one positioning system (8) of the insulation panel (4), wherein the positioning system (8) comprises:

a dagger (10) having a rod (12) provided with a bearing stop (13) and, a lock (11) provided with a counter-stop (16), the rod (12) having a first end ($\mathbf{12}_1$) intended to be in contact with a first form panel (6) and a second end ($\mathbf{12}_2$) intended to be in contact with a second form panel (7), so that a distance between the first and the second end is equal to a thickness of the wall (1), characterized in that the lock (11) is provided with at least two notches (17) for receiving a first reinforcement ($\mathbf{5}_1$), the at least two notches (17) being arranged on a circumference of the positioning system, extending between the first end ($\mathbf{12}_1$) of the rod (12) and the counter-stop (16), and being delimited by retaining stops (18), the retaining stops (18) being spaced apart so as to maintain in position the first reinforcement ($\mathbf{5}_1$), each of the at least two notches defining a housing with a profile converging in an opposite direction to a housing opening and arranged along the at least one positioning system (8) so as to be able to adjust the position of the first reinforcement ($\mathbf{5}_1$) according to a length of the positioning system (8).

2. The tooling according to claim 1, characterized in that the retaining stops (18) include a locking detent (20) at an opening of the notches (17).

3. The tooling according to claim 1, characterized in that the at least one positioning system (8) comprises a first hook (14) extending radially between the first end ($\mathbf{12}_1$) of the rod (12) and the counter-stop (16), and delimiting a first retaining stop ($\mathbf{18}_1$).

4. The tooling according to claim 1, characterized in that the at least one positioning system (8) comprises a second hook (21), angularly orientable and extending set back from the second end ($\mathbf{12}_2$) of the rod (12), in order to maintain in position a second reinforcement ($\mathbf{5}_2$).

5. The tooling according to claim 1, characterized in that a distance between the bearing stop (13) and the counter-stop (16) is equal to a thickness of the insulation panel (4).

6. The tooling according to claim 1, characterized in that the tooling includes devices for assembling (9) the form panels (6, 7) together, each device for assembling (9) including a tubular spacer (26), the tubular spacer (26) having an inside adapted to receive a tightening rod, each end of the tightening rod adapted for receiving a tightening member.

7. The tooling according to claim 1, characterized in that the lock (11) and the dagger (10) include assembly means (22, 23, 24) making possible to fix the lock (11) on the rod (12) in a fixed position along the rod (12).

8. The tooling according to claim 7, characterized in that the assembly means include at least one lug (22) arranged on the rod (12) of the dagger and cooperating with a housing (23) arranged on the lock (11) after rotation thereof.

9. The tooling according to claim 7, characterized in that the assembly means (22, 23, 24) between the lock (11) and the dagger (10) are of an irreversible or repositionable type.

10. The tooling according to claim 1, characterized in that one or more washers are threated on the rod (12) and are in contact with the bearing stop (13), defining with the counter-stop (16) a thickness of the insulation panel (4).

11. A method for manufacturing a wall (1) with two concrete walls (2, 3), between which at least one insulation panel (4) is trapped, the two concrete walls (2, 3) being manufactured simultaneously or substantially simultaneously by pouring concrete between the insulation panel (4) and a first form panel (6), and between the insulation panel (4) and a second form panel (7), the form panels (6, 7) being disposed on either side of the insulation panel (4), a first reinforcement ($5_1$) being placed on a side of the inner face of the first form panel (6), the insulation panel (4) being held between the two form panels (6, 7), before pouring the concrete, using positioning systems (8) passing through the insulation panel (4) and bearing on inner faces of the form panels (6, 7), the positioning system (8) comprising:

a dagger (10) having a rod (12) provided with a bearing stop (13) and, a lock (11) provided with a counter-stop (16), the method being characterized by:

placing on each insulation panel (4) before positioning thereof, positioning systems (8), each positioning system (8) including at least two notches (17) for receiving the first reinforcement ($5_1$), the at least two notches being delimited by retaining stops (18), said retaining stops (18) being spaced apart so as to maintain in position the first reinforcement ($5_1$), and extending between a first end ($12_1$) of the rod (12) and the counter-stop (16), the at least two notches defining a housing with a profile converging in an opposite direction to a housing opening and arranged along the positioning system (8), and positioning each insulation panel (4) with passage of the positioning systems (8) through the first reinforcement ($5_1$), the at least two notches (17) through which the first reinforcement ($5_1$) can be maintained allowing a positioning of the first reinforcement ($5_1$).

12. The method according to claim 11, characterized in that said method comprises placing a second reinforcement ($5_2$) on the side of the inner face of the second form panel (7), passage of at least a second hook (21) angularly orientable and extending set back from a second end ($12_2$) of the rod (12) and assembly of the at least a second hook (21) with said second reinforcement ($5_2$).

13. The method according to claim 11, characterized in that the positioning systems (8) are placed on each insulation panel (4) by threading the rod (12) of the dagger (10) up to the bearing stop (13), the lock (11) provided with the at least two notches (17) being assembled on the rod (12) protruding from the insulation panel (4), when the counter-stop (16) carried by the lock (11) bearing against the insulation panel (4).

14. The method according to claim 11, characterized in that the two form panels (6, 7) are maintained in position using assembly devices (9) by placing, each assembly device (9), before positioning the second form panel (7), being a tubular spacer (26) passing through the insulation panel (4) and after positioning the second form panel (7), sealingly bearing on the inner faces of the form panels (6, 7), each tubular spacer (26) having an inside adapted to receive a tightening rod, each end of the tightening rod adapted for receiving a tightening member.

15. The method according to claim 11, characterized in that the positioning of each insulation panel (4) with passage of the positioning systems (8) through the first reinforcement ($5_1$) further includes a rotation of the positioning systems (8) to ensure the engagement of the first reinforcement ($9_1$) in one of the at least two notches (17).

16. The method according to claim 11, characterized in that said method comprises placing a second reinforcement ($5_2$) on the side of an inner face of the second form panel (7), with rotation for passage of at least a second hook (21) angularly orientable and extending set back from a second end ($12_2$) of the rod (12) and assembly of the at least a second hook (21) with said second reinforcement ($5_2$).

17. The method according to claim 11, characterized in that the positioning systems (8) are placed on each insulation panel (4) by threading the rod (12) of the dagger (10) up to the bearing stop (13), the lock (11) provided with the at least two notches (17) being assembled on the rod (12) protruding from the insulation panel (4), the counter-stop (16) carried by the lock (11) bearing against the insulation panel (4) in the presence of one or more compensating washers.

* * * * *